United States Patent [19]

Heckenkamp et al.

[11] Patent Number: 4,891,621

[45] Date of Patent: Jan. 2, 1990

[54] AMBIENT COMPENSATOR FOR THERMAL OVERLOAD RELAY

[75] Inventors: Daniel P. Heckenkamp, Sussex; Roger J. Briggs, Colgate, both of Wis.

[73] Assignee: Eaton Corporation, Cleveland, Ohio

[21] Appl. No.: 312,521

[22] Filed: Feb. 21, 1989

[51] Int. Cl.[4] ..... H01H 37/70

[52] U.S. Cl. ..... 337/49; 337/57; 335/45

[58] Field of Search .....: 337/57, 82, 49, 48, 337/47, 46, 45; 335/42, 45

[56] References Cited

U.S. PATENT DOCUMENTS

| | | | |
|---|---|---|---|
| 2,872,548 | 2/1959 | Christensen | 337/49 |
| 4,520,244 | 5/1985 | Forsell et al. | 200/67 DA |
| 4,528,539 | 7/1985 | Forsell et al. | 337/49 |
| 4,691,182 | 9/1987 | Mrenna et al. | 335/42 |

*Primary Examiner*—H. Broome

*Attorney, Agent, or Firm*—L. G. Vande Zande

[57] ABSTRACT

A one piece member rests against a cam surface at a first end and against an adjustable pivot at a second end, biased thereagainst by an integral cantilever spring of said member, the distal end of which is interlocked in a deflected position to a hook formed in a housing. One end of a bimetal strip is riveted to the second end of the one piece member, the position of the other end of the bimetal strip being determined by manual adjustment of the pivot and the cam.

11 Claims, 2 Drawing Sheets

Fig. 1
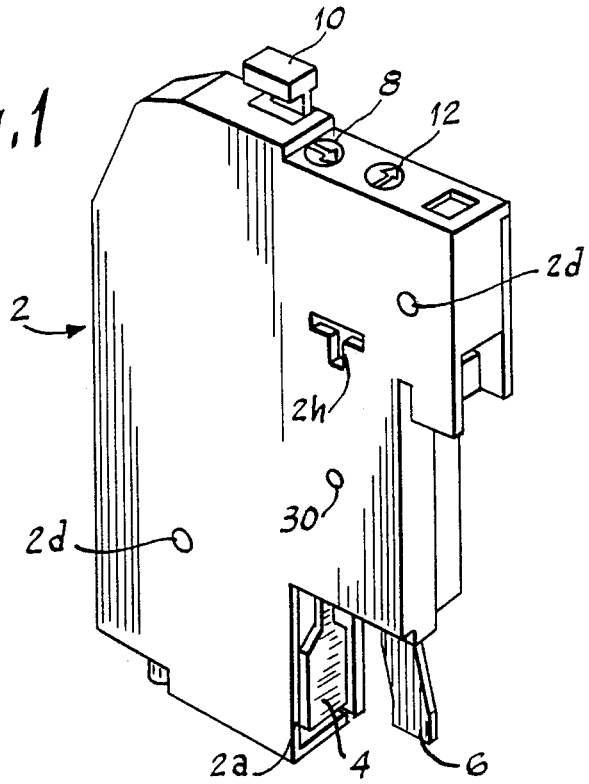
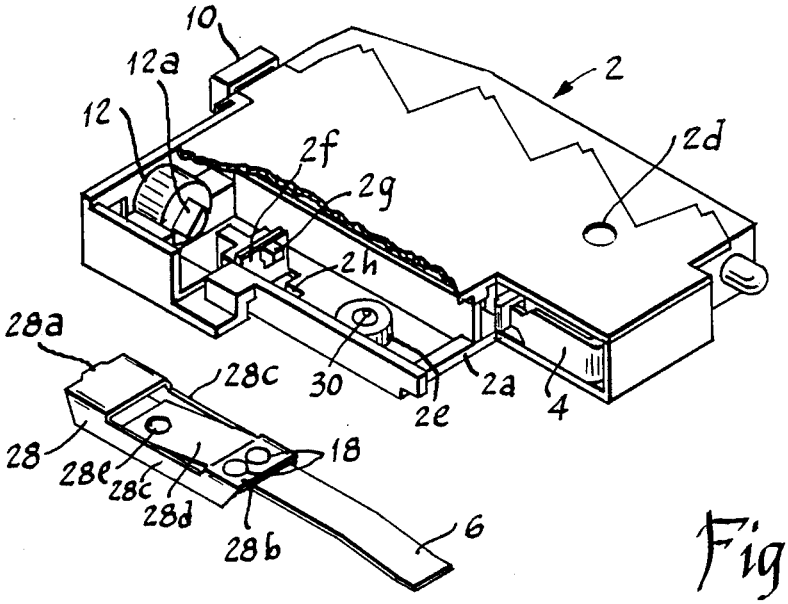
Fig. 6

AMBIENT COMPENSATOR FOR THERMAL OVERLOAD RELAY

BACKGROUND OF THE INVENTION

This invention relates to thermal overload relays such as that described in K. A. Forsell et al U.S. Pat. No. 4,528,539, issued July 9, 1985, assigned of this application, which patent is incorporated herein by reference. The thermal overload relay disclosed in that patent comprises a compartmented housing wherein thermally responsive bimetal members are positioned in the compartments, extending to a differential operating mechanism disposed in the lower portion of the relay housing. The differential operating mechanism comprises a driven slide bar and a follower slide bar interconnected by a crank pivotally attached to each respective slide bar on different axes. The relay features cassettes which mount in the respective narrow compartments of the housing, the cassettes each having a heater which is respectively connected in one phase of a plural-phase power supply, the heater being disposed in predetermined proximity to the associated bimetal element in the respective compartment. The relay also comprises a switch which is actuated by the differential operating mechanism crank. Associated with the switch is an ambient compensator which functions to arrest movement of the follower slide bar at a predetermined point to thereafter achieve differential movement between the driver slide bar and follower slide bar which effects switch actuating rotation of the crank. The ambient compensator comprises a bimetal element which extends into the path of the follower slide bar and deflects in the same direction as the bimetal elements in each compartment to nullify the affect of ambient temperature on the switch operating mechanism. The position of the ambient compensator is also manually adjustable to provide a range of current values at which the thermal overload relay will operate for each particular heater selection. The adjustment is accomplished by affixing the ambient compensating bimetal to an adjustment mechanism having one adjustment for factory calibration and another adjustment which is user operable to select a particular current setting from a current range. The adjustment mechanism has numerous parts, two pivot points, a factory calibration adjustment screw arrangement which must accommodate lateral motion of the screw, and a spring that tends to separate the housing base and cover. Although this mechanism has performed satisfactorily and is well suited for its intended purpose, the present invention relates to improvements thereover.

SUMMARY OF THE INVENTION

This invention provides an ambient compensating mechanism having mechanical adjustment to manually vary a current range of a thermal overload relay, which mechanism is readily assembled and adjusted from a few simple parts, is self retained within the housing, preferably is spring biased to a desired position without applying a separating bias to housing base and cover and is economically produced.

This invention provides a mechanically adjustable ambient compensating mechanism for a thermal overload relay wherein the ambient compensating bimetal is rigidly affixed to a spring which has cam follower, pivot, mounting and retention structures formed as integral portions of the spring. The housing for the switch in which the ambient compensator of this invention is contained is provided with an upstanding projection having a protruding hook, the projection cooperating with the spring to position the ambient compensator mechanism within the housing such that the spring is attached to the protruding hook to bias the cam follower into engagement with a manually adjustable dial cam and the pivot into engagement with a cooperating adjustable pivot structure, the spring affording both bias and retention of the assembly to the housing. These and other advantages of the invention will become more apparent when reading the following description and claims in conjunction with the accompanying drawings.

BRIEF DESCRIPTION OF THE DRAWINGS

FIG. 1 is an isometric view of a switch of a thermal overload relay which has a manually adjustable ambient compensating mechanism;

FIG. 6 is an exploded isometric view of the switch of a thermal overload relay with a portion of the cover broken away and the improved ambient compensating mechanism of this invention as utilized in said switch.

DESCRIPTION OF THE PREFERRED EMBODIMENT

Figure 3:
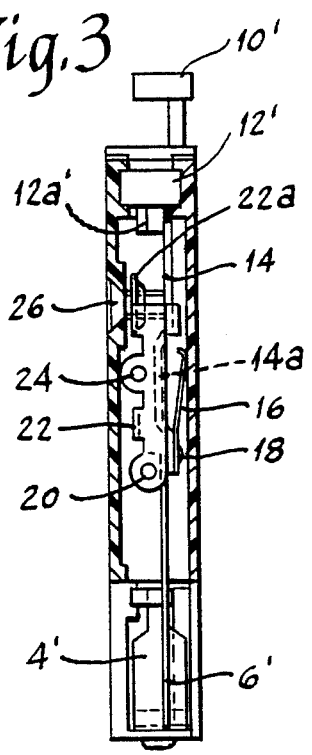
FIG. 3 is a sectional view taken along the line 3—3 of FIG. 2 showing the adjustable ambient compensating assembly of the prior art switch.

Referring to the drawings, FIG. 1 shows a switch 2 of the type utilized in a thermal overload relay such as that shown in U.S. Pat. No. 4,528,539 which is incorporated herein by reference. The switch housing is configured to be complementally received and attached at one end of the thermal overload relay housing. The housing of switch 2 is cut away at *2a* (the lower right-hand corner as viewed in FIG. 1) to expose a switch operator 4 and an ambient compensating bimetal 6 within a lower compartment of the thermal overload relay housing, which compartment contains a differential operating mechanism for operating the switch. The construction and operation of the electrical switch per se are not important to the operation add understanding of this invention, and have not been shown herein. However, reference may be had to U.S. Pat. No. 4,520,244 issued May 28, 1985 to K. A. Forsell et al and assigned to the assignee of this invention for an understanding of the construction and operation of the electrical switch. Switch 2 has a first rotary knob 8 positioned in the upper surface thereof which is manually setable to one of two positions to cause the switch 2 to operate in a manual or automatic reset mode. A manual reset pushbutton 10 is also provided in the upper surface of switch 2 to be operable when the knob 8 is in the manual reset position. A second rotary knob 12 is disposed in the upper surface of switch 2 and is operable through a partial revolution to adjust the position of the ambient compensator to vary the current value at which the thermal overload relay will trip switch 2.

Figure 2:
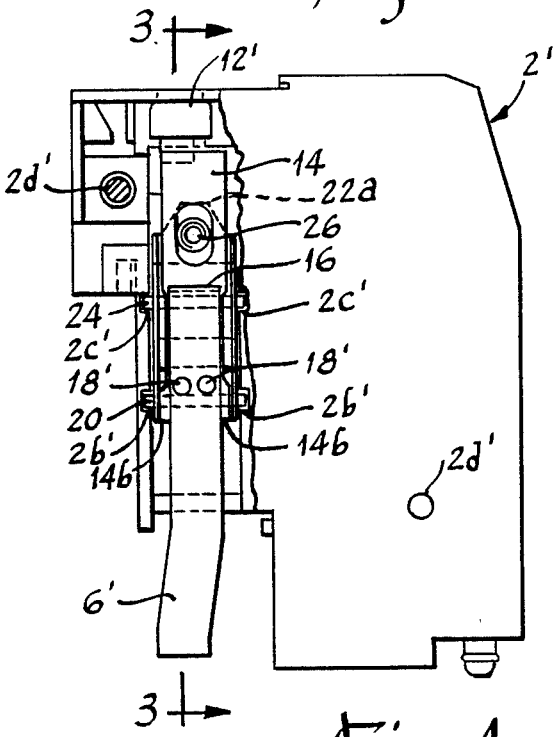
FIG. 2 is a side elevational view, with a portion of the cover broken away, of a prior art switch used in conjunction with the thermal overload relay of this invention, showing an adjustable ambient compensating assembly.

Referring to FIGS. 2 and 3, a prior art switch 2' of the type used in the thermal overload relay disclosed in U.S. Pat. No. 4,528,539 is shown. Identical counterparts in FIGS. 2 and 3 to parts of the switch 2 in FIGS. 1, 4–6 are given the same reference character distinguished by the prime (') notation. Switch 2' has an adjustable ambient compensating mechanism which comprises a compensating bimetal strip 6' and a rotary cam adjustment knob 12' journaled for rotation in the upper wall of the housing and cover of switch 2'. An eccentric cam 12a' extends from the bottom of knob 12'. The upper surface of knob 12' is exposed to the exterior of the switch and has a screwdriver slot shaped as an arrow for rotation of the dial and indication of its position.

The ambient compensating mechanism of the switch 2' comprises a carrier arm 14 which is offset at 14a near the lower end thereof to provide a relieved clearance area for a spring 16 rigidly affixed to the lower end of carrier arm 14 by rivets 18. The upper end of compensating bimetal 6' is also affixed to the lower end of carrier arm 14 by rivets 18. The lateral edges of carrier arm 14 have depending semi-circular ears 14b (FIG. 2) formed at right angles to the major plane of carrier arm 14, the ears 14b having aligned holes which receive a pin 20. Pin 20 is also received within aligned holes in the lower end of a cradle-shaped drive link 22 which is disposed below the carrier arm 14'. The ends of pin 20 lie within clearance slots 2b' in the housing of switch 2', the slots preventing pin 20 from sliding axially out of position with respect to carrier arm 14 and drive link 22. A second pin 24 is positioned in aligned apertures in drive link 22, the ends of pin 24 extending beyond the lateral edges of drive link 22 to be received in recesses 2c' in the housing of switch 2'. Slots 2c' determine the pivot axis for drive link 22 and are therefore more accurately located and formed than are slots 2b' which merely provide clearance for the pin 20. An upper leg 22a of drive link 22 is provided with an extruded tapped opening for cooperably receiving the threaded shank of a calibrating screw 26. Rotation of screw 26 moves the upper end 22a of drive link 22 either clockwise or counterclockwise about the pivot pin 24. This calibrating adjustment locates the pin 20 and therefore the pivot point for the carrier arm 14 and compensating bimetal 6'.

The entire system of drive link 22, pins 20 and 24, and carrier arm 14 and bimetal 6' are biased to the left (as viewed in FIG. 3) by spring 16 coacting against the cover of the housing of switch 2'. Spring 16 also biases carrier arm 14 into engagement with eccentric cam 12a' of knob 12'. Although the housing and cover of switch 2 are secured together by rivets such as 2d' (FIG. 2) the continuous pressure of spring 16 on the side wall of the cover may distort the cover or cause it to separate slightly from the base portion of the housing. Pivotal movement of drive link 24 in response to rotation of screw 26 causes a small amount of transverse translation of the screw 26 which is accommodated by enlarging the shape of a hole provided for screw 26 in the housing so unwanted forces are not introduced in calibration of the mechanism. Referring particularly to FIG. 3, rotation of knob 12' pivots the upper end of carrier arm 14 right or left about the pivot provided by pin 20 to adjust the lower end of compensating bimetal 6' left or right, respectively, to lengthen or shorten the movement of the follower slide bar of the differential operating mechanism. The ambient compensating mechanism with manual adjustment of the operating current range shown in FIGS. 2 and 3 requires a subassembly of six major parts providing two separate pivoting structures and two pivot points. The housing requires specifically toleranced slots 2c' and a specially shaped clearance hole for calibrating screw 26.

Figure 5:
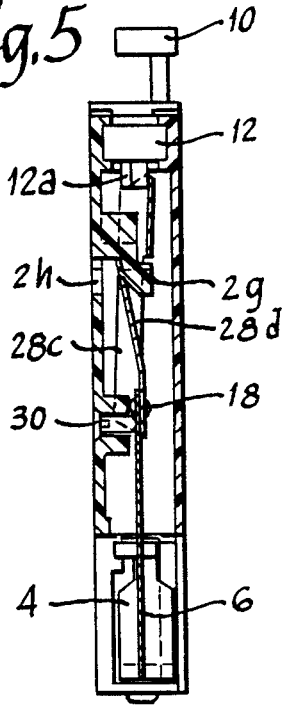
FIG. 5 is a cross sectional view taken along the line 5—5 of FIG. 4 showing the improved ambient compensating mechanism of this invention.
Figure 4:
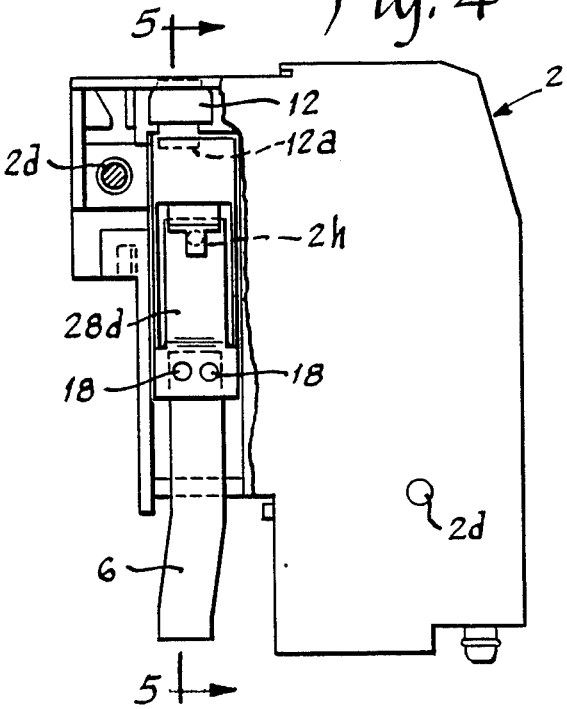
FIG. 4 is a side elevational view, with a portion of the cover broken away, of a switch similar to that disclosed in FIG. 2 but incorporating the improved ambient compensating mechanism of this invention.

Referring next to FIGS. 4, 5 and 6, the improved ambient compensating mechanism of this invention comprises two parts; ambient compensating bimetal 6 and a spring 28. These parts are secured together by a pair of rivets 18. Spring 28 is a one piece member having a first transverse end 28a and a second transverse end 28b joined by lateral arms 28c which are formed at right angles to the predominant plane of the spring which contains the planes of the transverse ends. The upper surface of spring 28 is cut by a U-shaped slot during formation of the spring to define a cantilever 28d integral with second transverse end 28b and which projects into the opening created by the U-shaped slot. The cantilever may be preformed to be angularly offset out of the predominant plane of the spring, preferably downwardly. A hole 28e is provided in the distal end of cantilever 28d. A cylindrical boss 2e is formed on the interior surface of the housing of switch 2 has a central hole therethrough into which a self tapping calibration screw 30 is driven. A locating structure 2f is also formed on the interior surface of the housing of switch 2 to extend toward the cover. Locating structure 2f has a hook 2g protruding from the lower side thereof. As seen in FIGS. 1, 5 and 6, it is necessary to provide a clearance hole 2h in the side wall of the housing of switch 2 immediately in line with the protruding hook 2g for purposes of molding the hook 2g.

The compensating bimetal and spring assembly is assembled to the switch 2 by placing the spring 28 over the locating projection 2f such that the lateral arms 28c straddle the edges of projection 2f. The first transverse end 28a of spring 28 is placed against the surface of eccentric cam 12a of knob 12 and the distal end of cantilever 28d is deflected downward under the hook 2g until the hook engages within hole 28e of cantilever 28d, thereby locking the assembly in position within the housing. Alternatively, cantilever 28d may be offset upwardly to abut against a surface of the cover of the housing if desired, whereupon that housing portion would have a cooperating structure to position the spring within the housing. The bias afforded by cantilever 28d forces the first transverse end into engagement with eccentric cam 12a and forces the second transverse end of spring 28 against the protruding end of calibrating screw 30 which serves as a pivot point for the ambient compensating assembly. In actuality, the back surface of ambient compensating bimetal 6 engages the protruding end of calibrating screw 30 immediately to the rear of second transverse end 28b of spring 28 inasmuch as the ambient compensating bimetal 6 is attached to the underside of the second transverse end. In any event, rotation of the self tapping screw 30 causes it to extend or retract within the housing of switch 2 and thereby to adjust the location of the pivot point for the spring 28 and compensating bimetal 6. As in the FIGS. 2 and 3 embodiment, rotation of knob 12 effects left or right movement of the first transverse end 28a of spring 28 as viewed in FIG. 5 which correlates to right or left, respectively, movement of the lower end of bimetal 6 to vary the position of that member in the path of the follower slide bar of the thermal overload relay.

The ambient compensating assembly of this invention provides a reduction of four parts over that of the prior art version, the elimination of one pivot point, and economic structural formation and assembly of the various elements by the provision of simpler, more readily fabricated parts. Although shown and described herein in the best mode contemplated for carrying out the invention, it is to be understood that the preferred embodiment shown herein is susceptible of various modifications without departing from the scope of the appended claims.

We claim:

1. A thermal overload relay having ambient compensating means which are mechanically adjustable to also provide a current range within which said relay operates comprising:

manually operable adjustment means, pivot means and locating means supported on a housing, said locating means being intermediate said adjustment means and said pivot means;

a spring comprising first and second transverse ends joined by lateral arms defining a central opening, a cantilever integral with said second end extending into said central opening, and a thermally responsive elongated member attached to said second end and projecting away from said spring oppositely to said cantilever;

said spring being disposed in said housing wherein said lateral arms extend along opposite sides of said locating means, said first end overlies said adjustment means and said second end overlies said pivot means, and a distal end of said cantilever engaging said housing and holding said cantilever deflected from a normal position thereof, thereby biasing said first end against said adjustment means and said second end against said pivot means.

2. The thermal overload relay defined in claim 1 wherein said cantilever is preformed angularly out of a predominant plane of said spring.

3. The thermal overload relay defined in claim 2 wherein said distal end engages said locating means.

4. The thermal overload relay defined in claim 3 wherein said distal end and said locating means comprise cooperating attachment means which interlock to attach said spring to said housing.

5. The thermal overload relay defined in claim 4 wherein said locating means comprises hook means and said cantilever has at least one aperture at its distal end biased into engagement with said hook means, attaching said spring to said locating means.

6. The thermal overload relay defined in claim 1 wherein said housing and said distal end comprise cooperating attachment means which interlock to attach said spring to said housing.

7. The thermal overload relay defined in claim 6 wherein said housing comprises one or more hooks and said distal end comprises apertures corresponding to and engaging with said hooks.

8. The thermal overload relay defined in claim 1 wherein said pivot means comprises a second adjustment means operable to adjust an initial position of said spring to calibrate said compensating means.

9. The thermal overload relay defined in claim 8 wherein said second adjustment means comprises a screw threadably mounted through said housing, said second end of said spring abutting a projecting end of said screw.

10. The thermal overload relay defined in claim 1 wherein said spring comprises a flat blank material and said lateral arms are formed at right angles to said transverse ends.

11. The thermal overload relay defined in claim 1 wherein said thermally responsive elongated member comprises a bimetallic strip which is arranged to deflect from its usual condition in response to increased ambient temperature in a same direction as thermally responsive elements of said overload relay deflect.

* * * * *